US005477662A

United States Patent [19]

Rompa

[11] Patent Number: 5,477,662

[45] Date of Patent: Dec. 26, 1995

[54] DEVICE FOR PACKAGING PRODUCTS IN BAGS

[75] Inventor: Jozef J. T. Rompa, Oosterhout, Netherlands

[73] Assignee: Quatre Mains B.V., Dongen, Netherlands

[21] Appl. No.: 325,351

[22] PCT Filed: Apr. 20, 1993

[86] PCT No.: PCT/NL93/00084

§ 371 Date: Oct. 21, 1994

§ 102(e) Date: Oct. 21, 1994

[87] PCT Pub. No.: WO93/21068

PCT Pub. Date: Oct. 28, 1993

[30] Foreign Application Priority Data

Apr. 21, 1992 [NL] Netherlands ..... 9200716

[51] Int. Cl.[6] ..... B65B 25/16; B65B 25/18; B65B 43/26

[52] U.S. Cl. ..... 53/571; 53/573

[58] Field of Search ..... 53/570, 571, 572, 53/384.1, 385.1, 469, 459, 573

[56] References Cited

U.S. PATENT DOCUMENTS

| | | | |
|---|---|---|---|
| 3,417,546 | 12/1968 | Irwin . | |
| 3,421,286 | 1/1969 | Chambless, Jr. | 53/570 |
| 3,421,287 | 1/1969 | Sheets . | |
| 3,538,671 | 11/1970 | Wallace | 53/572 X |
| 3,556,316 | 1/1971 | Marasso et al. | 53/572 X |
| 3,594,981 | 7/1971 | Pitts | 53/572 X |
| 3,699,741 | 10/1972 | Norman | 53/571 X |
| 4,047,362 | 9/1977 | Lister et al. | 53/572 X |
| 4,671,048 | 6/1987 | Rademacher | 53/572 |
| 4,805,381 | 2/1989 | Hannon | 53/572 X |

FOREIGN PATENT DOCUMENTS 1591884 of 0000 United Kingdom .

*Primary Examiner*—Horace M. Culver
*Attorney, Agent, or Firm*—Bell, Seltzer, Park & Gibson

[57] ABSTRACT

Device for packaging products, in particular bread, in bags, comprising a bearing guide (1) which guides a bearing part (2) which is driven in a reciprocating movement. The bearing part bears lower and upper scoops (7, 9) which can move relative to each other. During the movement of the bearing part, the scoops place a bag (13) over product (8). The lower scoop has a supporting surface (30) which, at least during the infeed of a product is inclined downwardly. A horizontal conveyance surface of discharge means (15) extends to just below the lower scoop. The device comprises a tilting unit in order to turn the scoops in such a way that the supporting surface assumes a horizontal position while a bag is being placed.

4 Claims, 2 Drawing Sheets

DEVICE FOR PACKAGING PRODUCTS IN BAGS

The invention relates to a device for packaging products, in particular bread, in bags, at least comprising feed and discharge means for the products, the feed means conveying the products at a level above the discharge means, a bearing guide extending essentially at right angles to the direction of conveyance of the products, for guiding a bearing part which can be driven in a reciprocating movement by a rotary drive motor by means of a main linkage assembly and bears a lower and an upper scoop, which scoops can be moved relative to each other during and as a result of the movement of the bearing part, the device being able to place a bag over a product to be packaged by means of the scoops mounted on the bearing part, while the product is retained by blockade means, and the lower scoop having a supporting surface which, at least during the infeed of a product to be packaged on the supporting surface, is inclined downwardly, viewed in the direction of conveyance of said product.

The bags which are used for packaging the products can be conventional bags which are open at one side, but it is also possible to use sleeves which are open at two sides and are cut from, for example, a hose-type material, the ends of which sleeves can be closed at a suitable moment.

Such a device for packaging products such as, for example, bread, is known from U.S. Pat. No. 3,451,192. In the case of the device described therein the lower and the upper scoop move into a bag which is being held open. Through the scoops moving apart the bag is stretched around front sides of the scoops. At the same time, the product to be packaged is placed by the feed mechanism on the part of the supporting surface of the lower scoop situated at the rear side. The supporting surface of the lower scoop in this case lies in the crosswise direction at an angle of 15° with the horizontal. The bag is pulled over the product to be packaged by moving back the bearing part, while a separate blockade part retains the product, and the packaged product falls onto a bottom plate which, like the scoops, is disposed in an inclined position. When the scoops are moved fully out of the bag, a pusher mechanism moves the packaged product from the inclined bottom plate onto the discharge means.

This had the disadvantage that a separate pusher mechanism is necessary for placing the packaged product on the discharge means. Problems also occur in the packaging of sliced bread when the lower scoop is being withdrawn from under the bread. Since, on the one hand, the loose slices do not begin to fall simultaneously and, on the other, they fall onto an inclined bottom plate, movements of the slices relative to each other occur, resulting in crumbs forming and the slices falling out of formation. Besides, at a subsequent stage the bread has to be tilted in such a way that it comes to rest in a horizontal position, which necessitates additional facilities, and increases the risk of further damage.

The invention eliminates these disadvantages by providing a device according to the preamble, in which the discharge means comprise an essentially horizontal conveyance face extending to just below the lower scoop, the two scoops are hingedly connected to the bearing part, and the device is provided with a tilting unit which is designed to turn the two scoops in such a way that the supporting surface is in a horizontal position when a bag has been placed over the product and the scoops move out of the bag.

It is advantageous if the feed and discharge means each can be placed at either side of the device with the result that the direction of conveyance can be reversed, and the tilting unit is adjustable, so that in the case of both directions of conveyance said unit can turn the supporting surface into a horizontal position during the placing of a bag over the product to be packaged.

In this way, one device will suffice for both directions, while in conventional devices for packaging products a separate construction of the device is necessary for each of the two possible directions of conveyance. Depending on the available space and the way in which it is fitted into the product stream, this device can be installed with conveyance in the required direction.

In this case a hinge pin is preferably fixed to the bearing part, and provision is made for an auxiliary linkage assembly which at one side is operated by a cam disc coupled to the drive motor, and at the other side acts upon the scoops in order to bring about their tilting movement, the rods of the auxiliary linkage assembly running parallel to the rods of the main linkage assembly and being connected thereto by means of transverse arms in such a way that a hinged parallelogram construction is formed. A reliable drive for the tilting movement is thus obtained, even at high operating speeds.

Finally, it is advantageous to fix to the bearing part, next to each other, two antisymmetrically formed hinge pin guides of a first type, lying essentially horizontal and at right angles to the direction of conveyance, and to fix to the scoops two likewise antisymmetrically formed hinge pin guides of a second type, a hinge pin hingedly coupling one of the hinge pin guides of the first type to the corresponding hinge pin guide of the second type, and the tilting unit acting upon a point of the scoops situated essentially in the mid-perpendicular plane of the two hinge pin guides of the first type.

In the case of such an embodiment the scoops can be made ready for reversing the direction of conveyance of the products simply by changing the position of the hinge pin.

The invention will now be explained in greater detail with reference to the drawing, in which.

Figure 1:
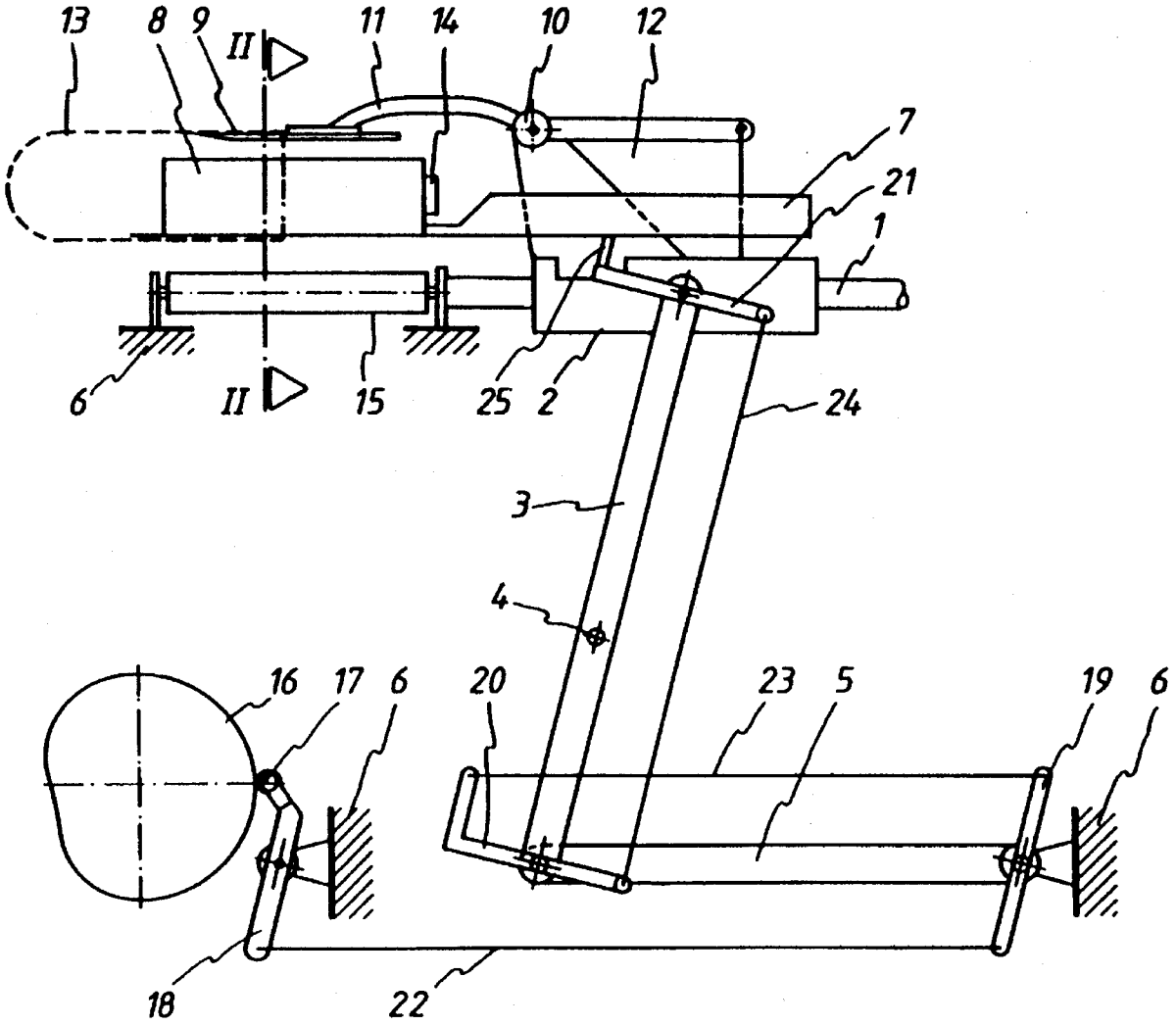
FIG. 1 shows a diagrammatic side view of an embodiment of a device according to the invention.

The embodiment shown in FIG. 1 comprises a bearing guide 1, on which a bearing part 2 moves to and fro when a drive motor (not shown) drives fixing point 4 of rod 3 to and fro by means of a drive rod (not shown either), which rod 3 is hingedly connected at one end to the bearing part 2 and at the other end is hingedly connected to machine frame 6 by means of rod 5. The bearing part 2 bears a lower scoop 7, which also forms a supporting surface for product 8, and an upper scoop 9, which is fixed to an arm 11 which pivots about shaft 10, the shaft 10 in turn being fitted on a supporting plate 12 mounted on the bearing part 2, and the pivoting arm 11 being operated by a linkage assembly (not shown), so that the upper scoop 9 can move relative to the lower scoop 7.

In FIG. 1 the bearing part 2 is situated halfway along a movement from left to right, a plastic bag 13 stretched around the scoops being pulled partially around the product 8, and the supporting surface 30 of the lower scoop 7 in the direction of conveyance forming an angle with the horizontal. When the scoops 7, 9 move further to the right, the plastic bag is pulled further over the product, and thereafter the upper scoop 9 is moved down slightly, following which the scoops move out of the bag. The product 8 is held in place by blockade plate 14 during this movement of the scoops. While the bag is being placed around the product, the supporting surface 30 of the lower scoop 7 goes into a horizontal position by means of a tilting unit, so that, when the scoops and the blockade plate 14 move out of the bag, the product can fall without considerable displacement onto the discharge belt 15 placed below the scoop 7, and can be discharged (see also FIG. 3).

Figure 2:
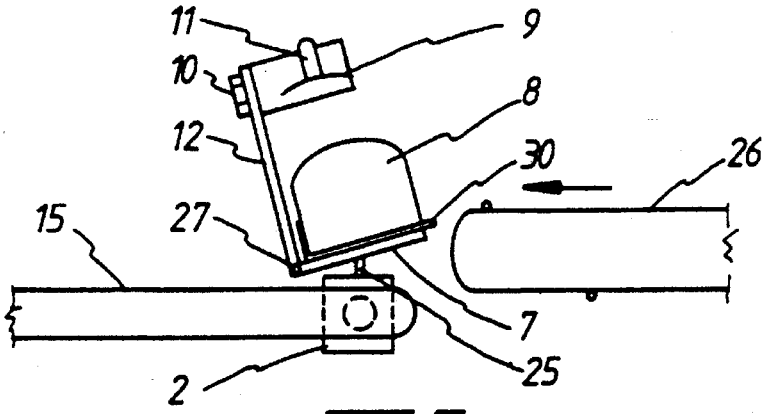
FIG. 2 shows a section along the line II—II of a part of the device from FIG. 1.

After this, the bearing part 2 moves to the left again, and the tilting unit causes the two scoops 7, 9 to go into an inclined position, which is advantageous for sliding the next product to be packaged onto the supporting surface 30 (see also FIG. 2).

The tilting unit from FIG. 1 is driven by means of a cam disc 16, which is coupled to the drive motor (not shown) of the device, a cam disc follower 17 pressing on said cam disc 16, the cam disc follower being rigidly connected to one end of a transverse arm 18 hingedly connected to the machine frame 6.

For tilting the scoops 7, 9, the movement of the cam disc follower 17 is transferred to a hinge part 25 fixed to a transverse arm 21, by means of the transverse arms 19, 20, 21 which are each rotatably mounted on hinge points of the rods 3, 5, and which are interconnected by hingedly connected auxiliary rods 22, 23, 24. Auxiliary rods 22, 23, 24 and transverse arms 19, 20, 21 form a parallelogram construction which is known per se, with two pairs of sides which are parallel at all times. The two scoops 7, 9 rest on the hinge part 25 in this case.

FIG. 2 shows the device with the scoops 7, 9 in an inclined position. Hinge part 25 of the tilting unit presses against the underside of the lower scoop 7. Hinge pin 27 of the scoops 7, 9 is situated on the left side of the bearing part 2 in this FIG. In addition to the scoops, a feed belt 26 for the products to be packaged is situated in line with the discharge belt 15, and is slightly raised relative thereto.

Figure 3:
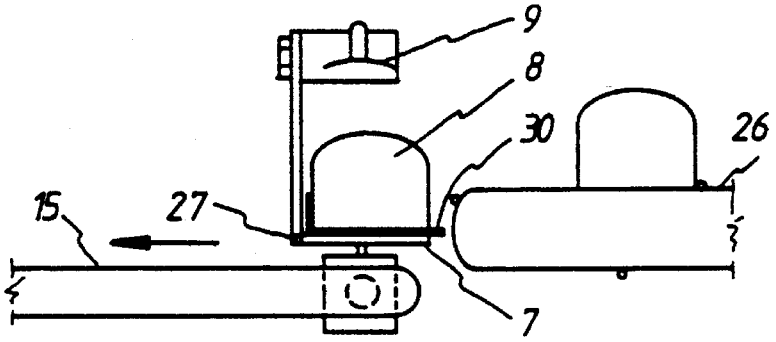
FIG. 3 shows the same section as that in FIG. 2, in which the scoops of the device are in the horizontal position.

In FIG. 3 the scoops 7, 9, and thus the supporting surface 30, are lying in a horizontal position. In this position the packaged product 8 can be placed on the discharge belt 15 and discharged.

Figure 4:
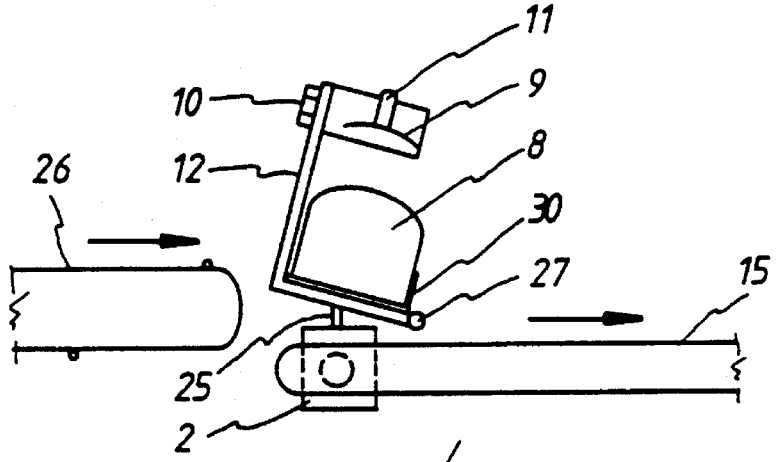
FIG. 4 again shows the same section as that in FIG. 2, but this time in a configuration in which the device functions with reversed direction of product conveyance.

In FIG. 4 the supporting surface 30 is inclined the other way, through the fact that the hinge pin 27 is fitted at the other side of the bearing part 2. The feed and discharge belts 15, 26 respectively have also changed positions, so that the machine is suitable for operation with the direction of conveyance reversed. The direction of conveyance is indicated by arrows in each case in FIGS. 2, 3 and 4.

I claim:

1. Device for packaging products, in particular bread, in bags, at least comprising feed means and discharge means (26, 15) for the products (8), the feed means (26) conveying the products at a level above the discharge means (15), a bearing guide (1) extending essentially at right angles to a direction of conveyance of the products, for guiding a bearing part (2) which can be driven in a reciprocating movement by a rotary drive motor by means of a main linkage assembly (3, 5) and bears a lower and an upper scoop (7, 9), which scoops can be moved relative to each other during and as a result of the movement of the bearing part, the device being able to place a bag (13) over a product to be packaged by means of the scoops mounted on the bearing part while the product is retained by blockade means (14), and the lower scoop (7) having a supporting surface (30) which, at least during the infeed of a product to be packaged on the supporting surface, is inclined downwardly, viewed in the direction of conveyance of said product, characterized in that the discharge means (15) comprise an essentially horizontal conveyance face extending to just below the lower scoop (7), the two scoops (7, 9) are hingedly connected to the bearing part (2), and the device is provided with a tilting unit which is designed to turn the two scoops (7, 9) in such a way that the supporting surface (30) is in a horizontal position when a bag has been placed over the product and the scoops (7, 9) move out of the bag.

2. Device according to claim 1, characterised in that the feed means and discharge means (15, 26) each can be placed at either side of the device with the result that the direction of conveyance can be reversed, and the tilting unit is adjustable, so that in the case of both directions of conveyance said unit can turn the supporting surface (30) into a horizontal position during the placing of a bag over the product to be packaged.

3. Device according to claim 1, characterised in that a hinge pin (27) is fixed to the bearing part (2), and provision is made for an auxiliary linkage assembly (18, 19, 20, 21, 22, 23, 24, 25) which at one side is operated by a cam disc (16) coupled to the drive motor and at the other side acts upon the scoops (7, 9) in order to bring about their tilting movement, rods (22, 23, 24) of the auxiliary linkage assembly running parallel to rods (3, 5) of the main linkage assembly and being connected thereto by means of transverse arms (19, 20, 21) in such a way that a hinged parallelogram construction is formed.

4. Device according to claim 2, characterised in that the bearing part (2) has fixed to it, next to each other, two antisymmetrically formed hinge pin guides of a first type, lying essentially horizontal and at right angles to the direction of conveyance, and the scoops have fixed to them two likewise antisymmetrically formed hinge pin guides of a second type, a hinge pin (27) hingedly coupling one of the hinge pin guides of the first type to the corresponding hinge pin guide of the second type, and the tilting unit acting upon a point of the scoops situated essentially in the mid-perpendicular plane of the two hinge pin guides of the first type.

* * * * *